US005413470A

United States Patent [19]

Eisenmann

[11] Patent Number: 5,413,470

[45] Date of Patent: May 9, 1995

[54] INTERNAL GEAR PUMP FOR WIDE SPEED RANGE

[76] Inventor: Siegfried A. Eisenmann, Conchesstrasse 25, 88326 Aulendorf, Germany

[21] Appl. No.: 205,613

[22] Filed: Mar. 3, 1994

[30] Foreign Application Priority Data

Mar. 5, 1993 [DE] Germany ..... 43 07 034.5
Sep. 9, 1993 [DE] Germany ..... 43 30 586.5

[51] Int. Cl.[6] ..... F01C 1/10

[52] U.S. Cl. ..... 418/171; 418/170; 418/78

[58] Field of Search ..... 418/75, 78, 166, 170, 418/171

[56] References Cited

U.S. PATENT DOCUMENTS 2,544,144 3/1951 Ellis ..... 418/78
4,767,296 8/1988 Satomoto et al. ..... 418/171

FOREIGN PATENT DOCUMENTS 3005657 1/1987 Germany .
3938346 4/1991 Germany .
3933978 8/1991 Germany .
4200833 4/1993 Germany .
0131878 6/1988 Japan ..... 418/171

*Primary Examiner*—Richard A. Bertsch
*Assistant Examiner*—Charles G. Freay
*Attorney, Agent, or Firm*—Renner, Otto, Boisselle & Sklar

[57] ABSTRACT

In an internal gear pump, which can also be constructed as pump with suction control, to reduce the undesired cavitation effects in the pressure region and to permit the oil to flow off from the diminishing displacement cells between the teeth of the gears, and impedance-controlled overflow passage is provided, the openings of which towards the moving displacement cells are alternately opened and closed by the teeth of at least one of the gears.

13 Claims, 5 Drawing Sheets

INTERNAL GEAR PUMP FOR WIDE SPEED RANGE

BACKGROUND OF THE INVENTION

1. Field of the Invention

The invention relates to an internal gear pump which may be constructed both as ring gear pump and as filling piece pump.

2. Description of the Prior Art

Such internal gear pumps must pass through a very wide speed range. They should have good volumetric efficiency at low speed and must therefore be made with narrow leak gaps. At the same time, however, at high speeds they should, as far as possible, not cause any cavitation noises due to vapour and air bubble cavitation on passage of the pumping medium from the suction side to the pressure side of the pump. These gear pumps are preferably employed as lubricating, delivery and shift or control pumps in internal-combustion engines and automatic transmissions in which in particular cavitation noises are found to be very annoying.

As a rule these gear pumps have a critical speed of rotation above which the delivery line deviates from the linear path and becomes increasingly flatter. The diagram according to the attached FIG. 1 shows the delivery stream QH (ordinate) as a function of the speed n (abscissa) and the deviation of the delivery line from the linear region from a critical speed $n_{krit}$. The delivery line then becomes increasingly flatter.

From the critical speed $n_{krit}$ onwards, the filling degree therefore becomes smaller than 1 and consequently there is a delivery medium shortage in the teeth chambers compared with the geometric delivery volume. The shortage space is partially filled with vapour of the delivery medium, partially with air separated from the medium and partially with "false air" sucked in through leakage points. This critical speed is fundamentally defined by a critical peripheral speed in the toothing region at which in accordance with Bernoulli's Law the static pressure in the liquid is increasingly absorbed by the velocity pressure (dynamic pressure). If the static pressure drops below the vapour pressure of the liquid, bubbles are formed which are subjected to the reduced static pressure and do not condense again until the static pressure of the bubble has risen above the vapour pressure.

It is remarkable that the critical speed of the gear pumps being considered here is almost independent of the viscosity of the medium. Normally, it would be expected that the critical speed would be substantially lower in the case of a very viscous medium than in the case of a thinly liquid medium. This is however not the case. A plausible explanation of this phenomenon is seen in that the dynamic pressure is linearly dependent only on the specific mass and is dependent upon the square of the velocity. Consequently, in similar pumps having about the same peripheral velocity the critical speed is also fairly exactly at the same point irrespective of the viscosity and the design of the pump (i.e. whether with or without filling piece). In practically no case has it proved possible to influence substantially the critical speed above which the pumps become appreciably louder by modifying the tooth flank forms or the inlet passage in the housing or by other constructional steps.

In a particularly simple design of such a pump the pinion has only one tooth less than the ring gear, i.e. the pump is a so-called gerotor pump in which each tooth of the pinion permanently cooperates in sealing manner with the toothing of the ring gear. In this case, fundamentally any form of toothing may be employed which is suitable for a gerotor pump and ensures adequate sealing between the teeth of the pinion and ring gear even in the pressure region of the pump. Particularly suitable for such a gerotor pump is a pure cycloid toothing in which the teeth heads and gaps of the gears have the profile of cycloids which are formed by rolling of roll circles on fixed circles extending concentrically to the respective gear axes, the teeth heads of the pinion and the teeth gaps of the ring gear each having the form of epicycloids which are formed by rolling of a first roll circle, the teeth gaps of the pinion and the teeth heads of the ring gear each having the form of hypocycloids which are formed by rolling of a second roll circle, and the sum of the circumferences of the two roll circles being equal in each case to the tooth pitch of the gears on the fixed tooth circles thereof. Examples of such toothings are described in German published specification 39 38 346.6 and German patent application P 42 00 883.2-15.

However, the difference between the teeth numbers of the pinion and ring gear may also be greater than 1. It should however not be large in order to ensure that a relatively small average teeth number is sufficient and consequently large displacement cells are retained. It is therefore preferred for the teeth number difference not to be greater than three.

If the teeth number difference is greater than one, in the region opposite the point of deepest tooth engagement usually a filling piece must be provided which fills at least the peripherally centre portion of the free space between the head circles of the two gears and thus ensures the necessary sealing there. This type of pump is distinguished by particularly good running quietness.

Such pumps are suitable for example for feeding hydraulic systems. In particular, such pumps are used however as oil or hydraulic pumps for motor vehicle engines and/or transmissions. Motor vehicle engines and transmissions are operated in a wide speed range. The speed basic values may be in the ratio of 12:1 or more.

The desired delivery of the lubricating pump of an internal-combustion engine, which in automatic transmissions must additionally perform the function of supplying pressure to the hydraulic shift elements and the converter filling for protection against cavitation, both in the case of the engine and in the case of the transmission, is proportional to the speed only in the lower third of the operating range. In the upper speed range the oil requirement increases far less than the speed of the engine. It is therefore desirable to have a drive-regulated lubricating or hydraulic pump or one having a displacement adjustable in dependence upon the speed.

The most common form of a hydraulic, oil and/or lubricating pump is the gear pump because it is simple, cheap and reliable. A disadvantage is that the theoretical delivery per revolution is constant, i.e. proportional to the speed.

Hitherto, the only practicable way of avoiding the unnecessary pump performance from a certain pump speed onwards with low losses was to control the suction. Since the flow resistances increase overproportionally with increasing liquid velocity, with a throttle in the suction conduit with increasing speed the static pressure increasingly drops in the intake opening of the gear chamber until the so-called cavitation pressure threshold is reached, i.e. until the pressure drops below the vapour pressure of the oil. The displacement cell content then consists partly of liquid oil, partly of oil vapour, and partly of inspired air and is subjected to a static pressure lying appreciably beneath the atmospheric pressure. It is a simple matter, for example by correspondingly narrow suction conduits or by an orifice or alternatively in controllable manner by a suction slide valve to define or control the flow resistances in the suction conduit in such a manner that extensive adaptation of the useful displacement of the gear pump to the requirement line of the consumption is achieved.

A disadvantage with this control is once again the cavitation which occurs. For if the cell content consisting of liquid and gas subjected to a low absolute pressure is suddenly transferred to zones of higher pressure, as is inherent in the system of such pumps, the gaseous constituents of the cell content implode so violently that undesired noises, and even worse destruction of the cell walls, are the result.

To avoid these implosions, by shortening the outlet mouth in the region of the diminishing displacement cells the cell content is given enough time by gradual compression to increase the static pressure by an adequate extent so that when a cell comes into communication with the outlet passage no implosions of gas bubbles can take place therein because due to gradual reduction of the cell volume said gas bubbles have already condensed to liquid again or have dissolved in the liquid. The diminishing displacement cells must be sealed so well with respect to each other here that the expulsion pressure through the gap between the two teeth separating two consecutive displacement cells from each other cannot propagate itself to any appreciable extent against the displacement direction. The prevention of extremely high squeeze oil pressures at low speed is ensured constructionally in that on the displacement side of the pump the cells come into communication with the displacement pressure space so that if the cell is not filled completely with liquid the displacement pressure cannot become active therein. If however the cells are already completely filled with liquid on the suction side, which is the case in the lower speed range, the higher squeeze pressure in the cell opens the check valve in the direction towards the pressure displacement space so that the displaced oil can flow into the pressure space with only a slightly increased cell pressure compared with the displacement pressure, corresponding to the opening pressure of the check valve and the flow resistance thereof.

Such a construction is known from DE-PS 3,005,657. In the latter axial bores leading to the outlet passage extend over the entire pressure half of the pump in the housing and contain check valves which are spaced from the gear chamber and which open only when the pressure of the cell lying in front of the respective bore exceeds the pressure in the outlet passage.

This pump has a correspondingly large axial extent. The spring valve used can break. Also, the inconstant connection of the displacement cells to the outlet passage is disadvantageous. Finally, the pressure distribution in the pump is disadvantageous as regards avoiding cavitation-induced implosions and the pump is loud in operation.

Considerably more advantageous is the gerotor pump known from German patent 3,933,978 in which the problem of the squeeze oil removal in the diminishing displacement cells at low speed with cavitation-free operation is solved in that in the teeth of at least one gear passages connecting displacement cells adjacent the respective tooth are provided in which check valves are located which permit a flow through the respective passage only in the displacement direction. However, this pump is also undesirably loud in operation at higher speeds.

SUMMARY OF THE INVENTION

The problem underlying the present invention is to reduce appreciably the noises caused by cavitation in an internal gear pump of the type indicated.

This problem is solved by an internal gear pump for a wide speed range comprising

- a housing containing a gear chamber,
- a ring gear in the housing,
- a pinion which has one tooth or only a few teeth less than the ring gear, meshes with the ring gear and is arranged in the latter,
- the teeth of which form together with the teeth of the ring gear increasing and again diminishing consecutive displacement cells for the working liquid and seal said cells with respect to each other,
- inlet and outlet passages passing through the housing for the supply and discharge of the operating liquid,
- which open into the gear chamber on both sides of the point of deepest tooth engagement,
- said mouths being passed over by the displacement cells,
- and furthermore the end of the mouth of the outlet passage lying remote from the point of deepest tooth engagement is located so close to the point of deepest tooth engagement that between it and the point at which the displacement cells start to diminish there is always more than one displacement cell, wherein

- in the region of diminishing displacement cells in the wall of the gear chamber peripherally spaced from the mouth of the outlet passage at least one opening is located over which alternately displacement cells and teeth defining said cells pass,
- in which the opening is connected via a connecting passage to the outlet passage, and
- the opening on each passage of a tooth thereover is covered by said tooth completely or at least to a major degree.

Expedient embodiments are defined by the features of the subsidiary claims.

The advantages obtained with the invention are based on the following mode of operation: the period of time of static pressure increase in the displacement cells is increased in the peripheral direction to an adequate extent to ensure that the pressure gradient dp/dt becomes smaller. As a result, the bubbles have enough time to dissolve again or condense whilst still in the low-pressure region. The feared violent implosion of the bubbles under high pressure, leading to noises and cavitation damage, is thereby avoided. This extension of the compression phase must not however lead to squeezing occurring with 100% filling of the cells with compact liquid, i.e. in the low speed range. This would then lead to noises of a different type and to power losses.

In such a pump, squeeze oil can flow off into an outlet passage through an opening from the diminishing displacement cells. If the pump is running at low speed, all the displacement cells in the suction region of the pump are fully filled with operating liquid. Before they can be appreciably diminished, these full displacement cells intersect the opening or openings in the pressure region. During the diminishing of the displacement cells which then occurs, the squeeze oil flows through a connection passage into the outlet passage. If the speed further increases until the occurrence of cavitation in the inlet mouth and the region of the enlarging displacement cells, the flow in the connection passage to the outlet passage slows down and comes to a stop on further increase of the speed, finally even being reversed. This reversed flow of operating liquid from the outlet passage into the diminishing displacement cells remains however small because due to the alternating opening and closing of the opening or openings by the teethepassing thereover, becoming increasingly fast with increasing speed, the operating liquid column in the connecting passage must be continuously retarded to zero and accelerated again and this leads to a very high apparent flow resistance in said passage at high speed of the pump. The thus remaining weak liquid flow from the outlet passage into the diminishing displacement cells containing cavitation bubbles is too small to allow these cavitation bubbles to collapse abruptly on the path from the start of the displacement cell diminishing up to the mouth of the outlet passage and consequently the slow pressure rise avoiding the feared cavitation damage and cavitation noises is retained.

At low speed of the pump the apparent resistance generated by the continuous acceleration and retardation of the liquid column in the connecting passage no longer plays any part because here the processes take place correspondingly more slowly. The squeeze oil can flow off through the opening(s) and the connecting passage. The transition from one state to the other in the connecting passage is a gradual one.

Each opening is covered completely, or at least to a major extent, each time a tooth passes thereover.

The connecting passage preferably leads via the outlet mouth into the outlet passage.

According to a preferred embodiment, the opening is kept small in comparison with the mouth of the outlet passage and the cross-section of the connecting passage is kept small in comparison with that of the outlet passage. The smaller the opening and the cross-section of the connecting passage, the greater the hydraulic apparent resistance will be. The ratio of the size of the opening to that of the mouth of the outlet passage and of the cross-section of the connecting passage to that of the outlet passage may for example be 5% or 10%. To retain the dependence of the flow apparent resistance on the speed of the pump utilized in the invention, a certain length of the connecting passage is of course also required. This is however obtained automatically because the opening must of course have a certain distance from the outlet passage mouth. Generally, it may be stated that the length of the connecting passage should be a multiple of the characteristic length of its cross-section.

The magnitude of the apparent resistance may also be influenced by the arrangement of the opening in the radial direction. The closer the opening lies to the foot circle of the gear, the greater the period of time in which the opening is covered by teeth compared with the period of time in which the opening lies opposite teeth gaps, i.e. is open towards displacement cells.

It is therefore preferred for the opening to be formed as a groove in the end wall of the gear chamber extending in the peripheral direction near the foot circle of the toothing of the pinion, or rather ring gear. The formation in the region of the foot or root circle of the ring gear is preferred because more room is available here for the provision of the opening and the connecting passage. By forming the opening as a groove extending in the peripheral direction in an end wall of the gear chamber, the opening can be easily dimensioned as desired with regard to the impedance effect.

The extent of the opening in the radial direction is preferably one fifth to one third of the height of the teeth passing thereover.

The connecting passage can for example open directly into the outlet passage and be cast as tubular passage into the wall of the pump housing. It is however preferred for the connecting passage to be formed as a groove in the wall of the gear chamber covered by the body of the gear carrying the teeth passing thereover. Said groove is advantageously located in the end wall of the .gear chamber and not in the peripheral wall. The latter would be more complicated in the mechanical formation of the groove.

If the mean tooth number of the pump is small, i.e. if only one or two displacement cells not open towards the mouth are always located in the region of diminishing displacement cells in front of the mouth, then no more than one opening will be required. With a relatively large tooth number with which the number of diminishing displacement cells in front of the mouth of the outlet passage is relatively high, it is advisable to provide several openings offset in the peripheral direction since to enable the opening to serve an adequate number of cells said opening would otherwise have to be so long that the apparent resistance would in turn become too small because an at least approximately complete covering of the opening would no longer be possible.

Generally, it can be stated that the number of openings is preferably at the most one smaller than the maximum number of closed displacement cells between the starting point of the displacement cell diminishing and the start of the pressure mouth.

If several openings are provided, they may advantageously be arranged in series in the peripheral direction and have a spacing in said direction of about ½ of the tooth pitch. This does not refer to the spacing of the opening centres but in each case to the spacing of the opposing opening edges from each other.

Basically, each opening, the number of which will in any case not be large in practice in pumps for motor vehicle engines and transmissions, maybe connected via a separate connecting passage to the outlet passage. Preferably, however, the openings are connected via a common connecting passage to the outlet passage.

In a preferred embodiment of the internal gear pump with the teeth number difference 1, the spacing of the opening from the mouth of the outlet passage in the peripheral direction is substantially equal to half the spacing between the end of the mouth of the inlet passage and the end of the mouth of the outlet passage.

If the teeth number difference is greater than 1, i.e. the pump has a filling piece in a space between a head circle of the ring gear and a head circle of the pinion opposite the point of deepest tooth engagement, the spacing of the opening from the pressure side end of the filling piece measured in the conveying direction is preferably substantially equal to zero.

A preferred embodiment of the internal gear pump according to the invention comprises a suction control with a fixed or variable throttle provided in the inlet passage. The advantages described above of a suction control can therefore be integrated in this manner into the internal gear pump according to the invention.

Preferably, the extent of the openings in the peripheral direction is substantially equal to the thickness of the teeth passing thereover at the radial height of the opening. This ensures at low speed adequate squeeze oil flow and at high speed adequately high throttling.

The arrangement of the opening in the peripheral direction is also of significance. Preferably, the distance of the opening from the mouth of the outlet passage in the peripheral direction is substantially equal to the tooth pitch.

BRIEF DESCRIPTION OF THE DRAWINGS

Hereinafter the invention will be explained in detail with reference to two preferred embodiments illustrated as examples in the drawings, wherein.

DESCRIPTION OF THE PREFERRED EMBODIMENTS

Figure 2:
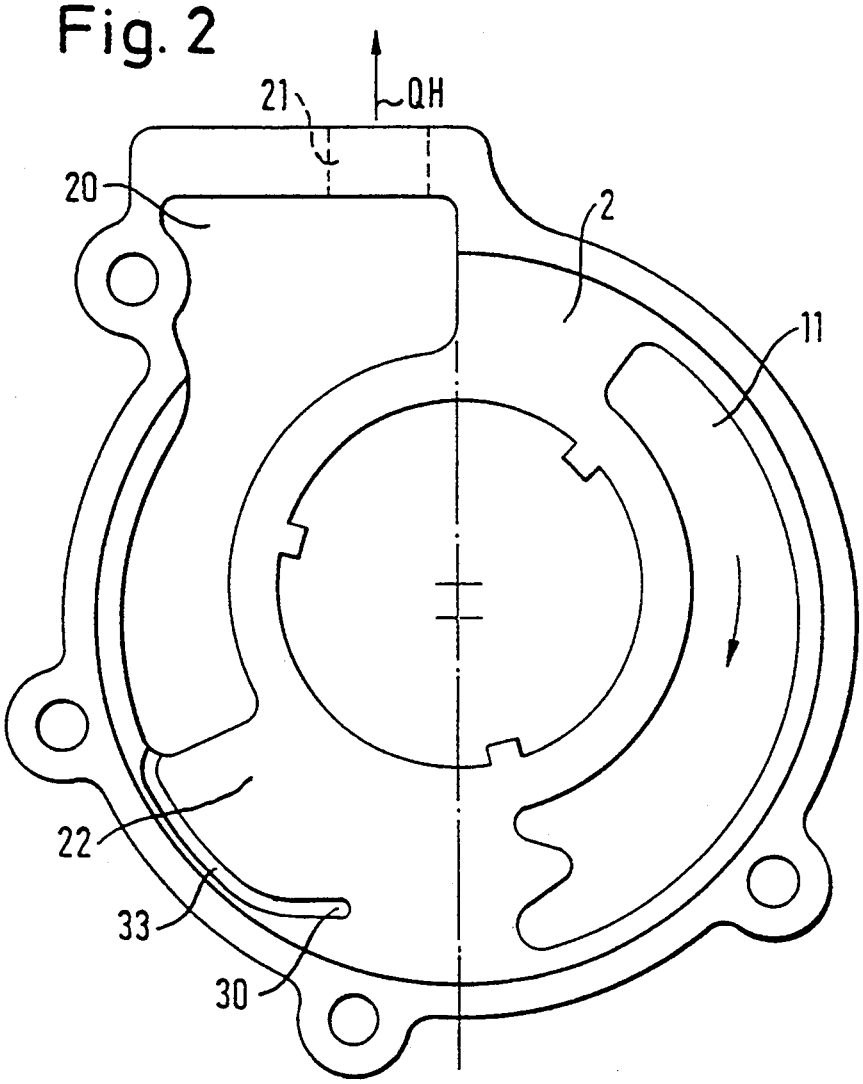
FIG. 2 is a plan view of the end wall, formed as housing, of the gear chamber of an internal gear pump.

In FIG. 2 the end wall of the cylindrical gear chamber is shown constructed as housing. On the right side of FIG. 2 there is the kidney-shaped inlet mouth 11 formed as a trough in the cover; the flow direction in the inlet mouth 11 is indicated by an arrow. On the left side of the housing shown in FIG. 2, denoted by the reference numeral 20, is the outlet mouth or kidney 20 likewise formed as trough in the housing wall. Beneath the mouth 20, the connecting passage 33 formed there is indicated and the opening 30 thereof at its end opposite the flow direction.

Figure 3:
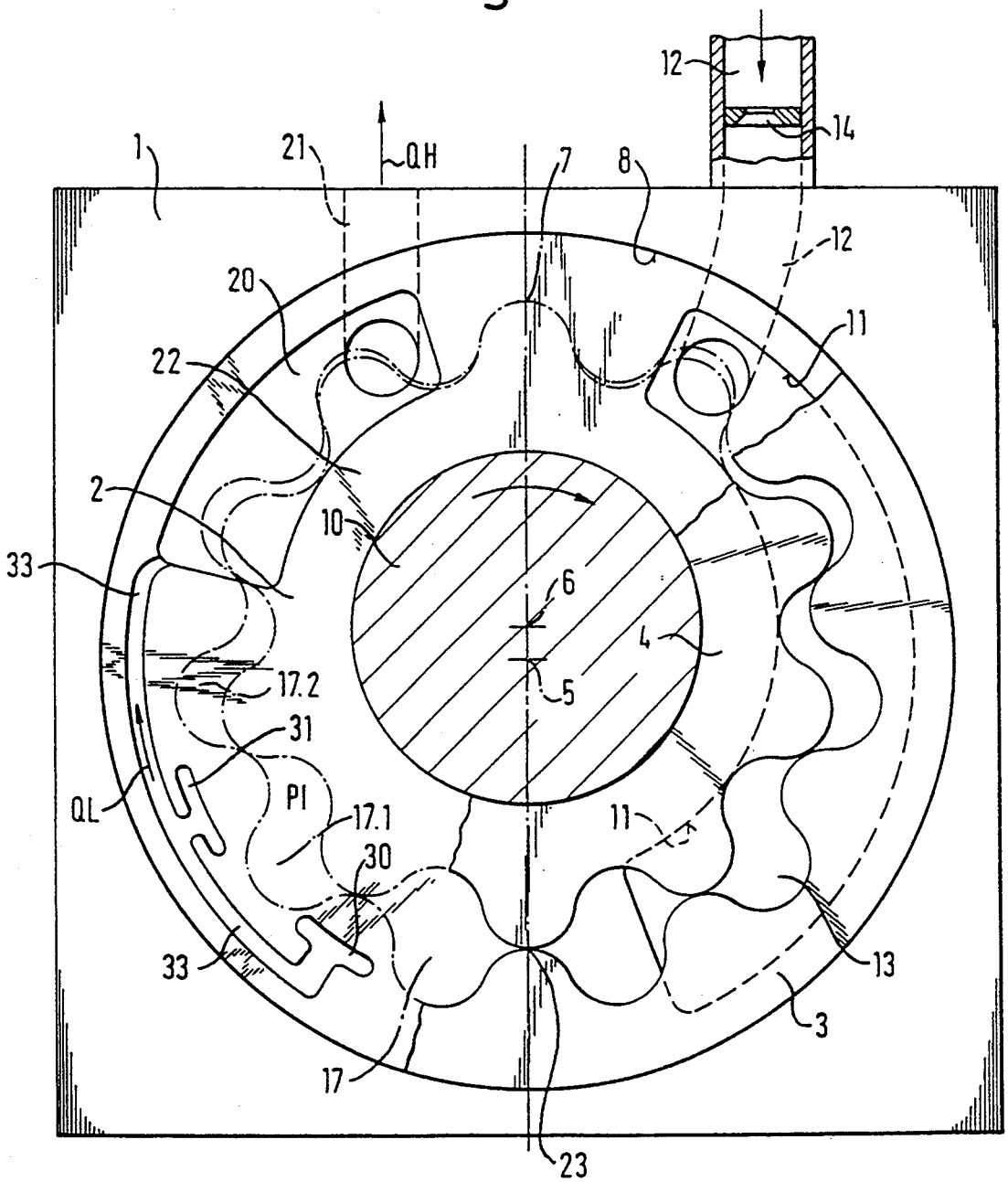
FIG. 3 illustrates schematically a gerotor pump according to the invention in which the housing cover is removed and for greater clarity the gears are only partly shown.

The pump illustrated schematically in FIG. 3 comprises a pump housing 1 from which the cover is removed so that the cylindrical gear chamber 2 is open and can be seen; in said chamber a ring gear 3 is mounted with its periphery on a peripheral wall 8 of the gear chamber 2. Also located in the gear chamber 2 is a pinion 4 which is carried by a drive shaft 10 of the pump. In this respect other mountings are also possible. The pinion has ten teeth and the ring gear 2 has eleven teeth. The toothing is of the type in which all the teeth of the pinion 4 are in permanent engagement with the toothing of the ring gear 3. As a result, all the displacement cells 13 and 17 formed by the teeth gaps of pinion and ring gear are permanently adequately sealed with respect to adjacent displacement cells. The direction of rotation of the pump is clockwise, as indicated by the arrow on the shaft 10.

The toothing of the gears is a pure cycloid toothing. In the latter the teeth heads and teeth gaps both of the ring gear and of the pinion have the profile of cycloids which are formed by the rolling of small roll circles, the periphery of each of which is equal to half the tooth pitch, along the reference circle of the respective gear. The teeth heads of the pinion and the teeth gaps of the ring gear each have the form of epicycloids whilst the teeth gaps of the pinion and the teeth heads of the ring gear each have the form of hypocycloids. The diameters of the roll circles forming the epicycloids are equal to the diameter of the roll circles forming the hypocycloids. Such a toothing is described in detail in DE-OS 3,938,346.

Figure 1:
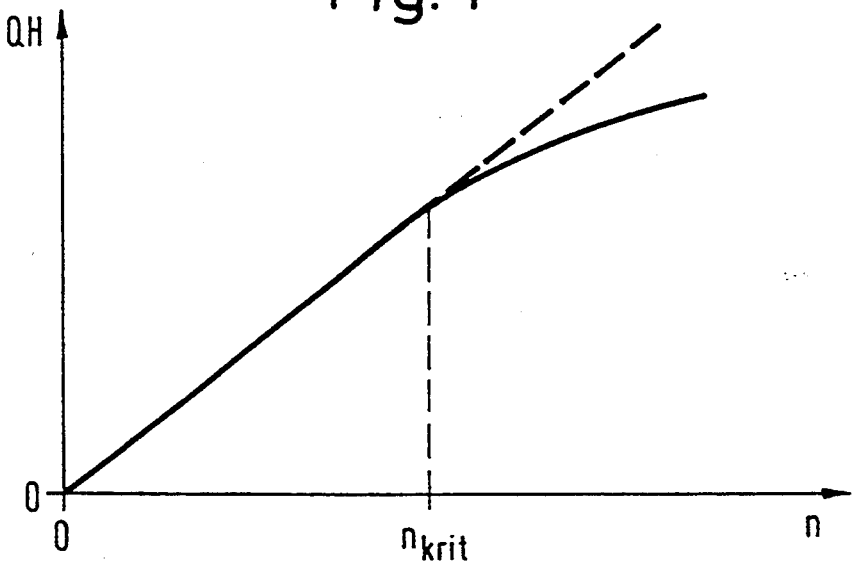
FIG. 1 is a delivery stream/speed diagram for a gear pump.

In the end wall 22 of the gear chamber 2 lying behind the plane of the drawing in FIG. 3 an intake opening 11 is provided which in FIG. 3 is partially covered by the gears 3 and 4 shown broken away. The tooth contour of the two gears is illustrated in FIG. 1 in dot-dash line over the remaining periphery. The centre of the ring gear 3 is indicated at 5 and the centre of the pinion 4 at 6.

The point of deepest tooth engagement is indicated at 7; the point 23 of the tooth apex contact is diametrically opposite the point 7.

In the right half of the Figure, in the end wall 22 of the gear chamber 2 facing the observer, the mouth 11 of the supply passage 12 can be seen in said end wall as depression, an orifice 14 serving for suction control being inserted into said passage 12. The mouth 11 is also referred to as suction kidney. It extends in the peripheral direction from a point near the point 7 of deepest tooth engagement up to close to the point 23 of apex contact.

In the left figure half of FIG. 3 the mouth 20 of the outlet passage 21 is located and is likewise formed as depression in the visible end wall 22 of the gear chamber 2. As can be seen, the outlet mouth or kidney 20 is substantially smaller than the inlet mouth 11. Whereas the end of the outlet mouth 20 lying in the direction of rotation has substantially the same spacing from the point 7 of deepest tooth engagement as the inlet mouth 11, the end of the outlet mouth 20 lying opposite the direction of rotation is spaced from the point 7 of deepest tooth engagement a distance of only about 80°.

As described so far within the framework of the example of embodiment the construction of the pump housing is known.

In FIG. 3, on the path from the point 23 of the tooth apex contact up to the start of the outlet mouth 20 three displacement cells 17, 17.1 and 17.2 surrounded by dot-dash lines can be seen, which convey liquid migrating in the clockwise sense from the inlet mouth 11 to the outlet mouth 20. In the path of the displacement cells, close to the tooth foot circle of the ring gear 3, corresponding to the relatively large tooth number, in the end wall 22 of the gear chamber 2 two openings 30 and 31 are provided which extend in the peripheral direction in said end wall. The openings 30 and 31 extend close to the foot circle of the toothing of the ring gear 3 within said foot circle. Each of the two openings 30 and 31 is connected via a short radially outwardly extending passage piece to the connecting passage 33 extending in peripheral direction and connected to the mouth 20 of the outlet passage. The radial passage portions, the openings 30, 31 and the connecting passage 33 are formed as grooves in the end wall 22 of the gear chamber 2. They may for example have a rectangular cross-section with rounded corners, the depth being about equal to the width of the groove indicated. The connecting passage 33 is continuously covered by the annular portion of the ring gear 3 bearing the teeth.

Since shortly after leaving the point 23 of the tooth apex contact the displacement cells are still gradually diminishing, the end of the first opening 30 facing said point may have a relatively large angular distance in the peripheral direction from said point, said distance here being substantially equal to two-thirds of the tooth pitch of the ring gear passing over said opening, measured in angular units. Compared therewith, the end of the opening 31 lying in the conveying direction is substantially further remote from the opposing end of the outlet opening 20, that is slightly more than one tooth pitch, so that whenever a displacement cell looses contact with the opening 31 it immediately starts to open into the outlet opening 20. The spacing of the opposing ends of the two openings 30 and 31 is so large that the two openings 30 and 31 are never connected by a displacement cell; it may however also be somewhat larger if the openings are narrow.

When designing the openings 30 and 31 account is also to be taken of the radial position of said openings. Thus, to obtain equal opening and closing times the extent of the openings 30, 31 in the peripheral direction must be the smaller the greater the distance of the opening from the tooth foot circle of the ring gear 3. To indicate this, the opening 30 is shown lying radially somewhat further inwardly than the opening 31, being however then also somewhat shorter than the latter. The two openings are relatively short in the example shown. In many cases it will also be possible to make them somewhat longer.

Figure 5:
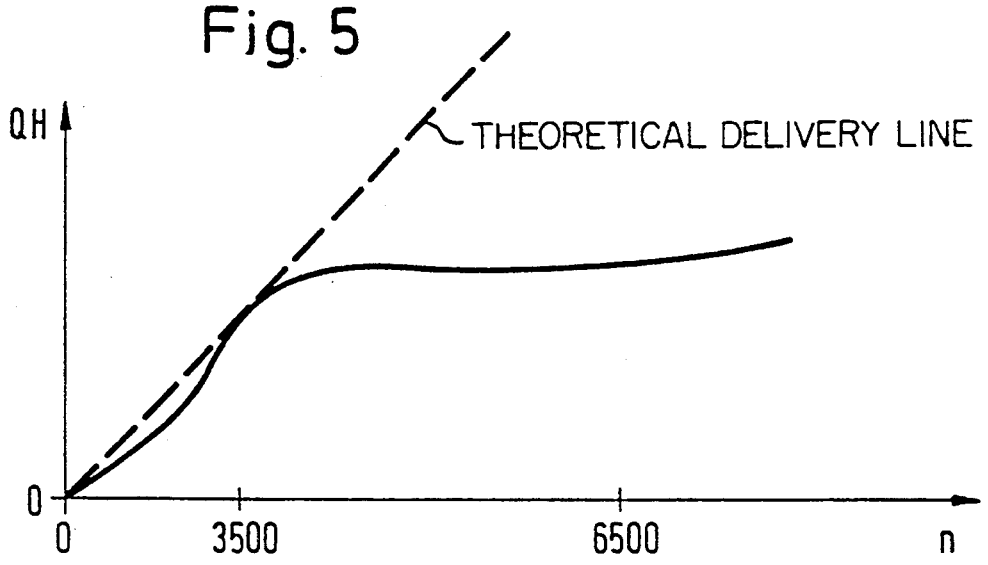
FIG. 5 illustrates the delivery flow QH as a function of the speed n for a pump according to the invention.
Figure 6:
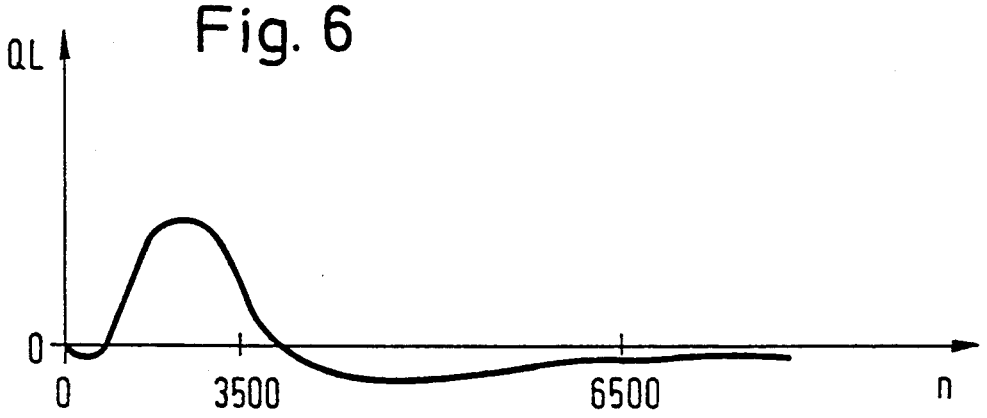
FIG. 6 shows the leakage oil flow QL in the connecting passage as a function of the speed n for such a pump.

In operation of the ring gear pump according to FIG. 3 at low speed the squeeze oil flow QL through the passage 33 corresponds to the displacement volume of the displacement cells 17, 17.1 and 17.2. Now, with increasing speed the flow resistance to the flow through the passage 33 also increases because the opening times for the openings 30 and 31 become increasingly shorter. Accordingly, the pressure PI in the cells 17, 17.1 and 17.2 increases with a simultaneous drop of the squeeze oil flow QL through the conduit 33. These conditions however apply only up to the speed at which no cavitation takes place in the intake mouth 11, i.e. in the displacement cells 13. In the cavitation range at higher speed, where the delivery line (FIG. 5) has accordingly passed from the linearly rising curve to an approximately horizontal line, the pressures PI in the displacement cells drop to close to atmospheric pressure. Since the intake pressure is kept constant with the speed, the QL curve now passes through the zero point and even becomes slightly negative. This means that oil flows to a slight extent from the outlet opening 20 through the connecting passage 33 back into the displacement cells 17, 17.1 and 17.2. At very high speed, which is not employed in practice, the negative leakage oil flow QL from the outlet opening 20 to the openings 30 and 31 would again approach the zero line due to the increase in the apparent flow resistance (FIG. 6).

Figure 7:
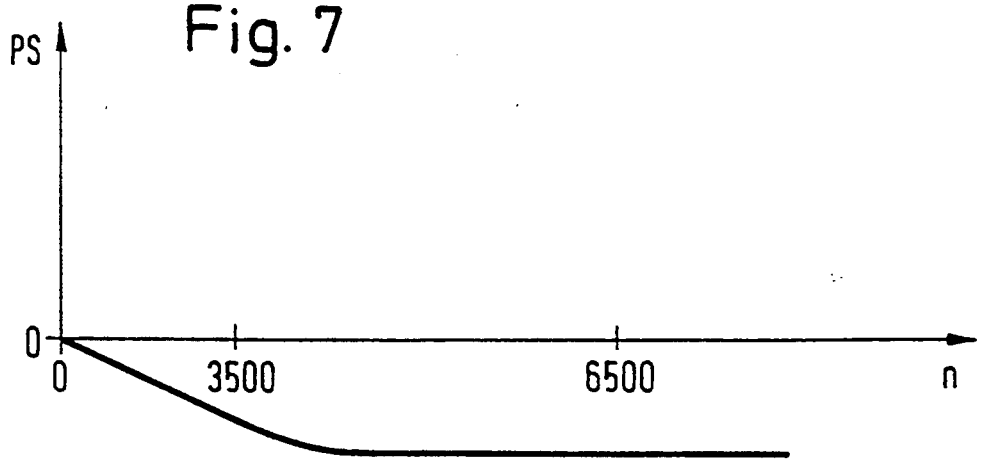
FIG. 7 shows the suction pressure PS in the inlet mouth as a function of the speed n for such a pump.
Figure 8:
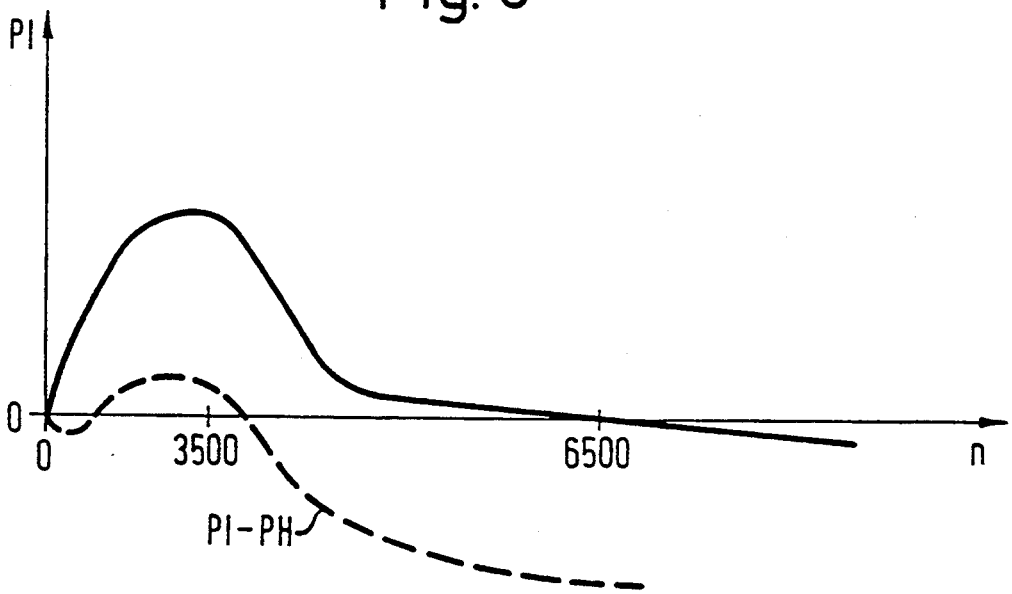
FIG. 8 shows the intermediate pressure PI and the pressure difference PI—PH as a function of the speed n for such a pump.

FIG. 7 shows the corresponding suction pressure PS in the inlet mouth as a function of the speed whilst FIG. 8 represents the intermediate pressure PI and the pressure difference PI−PH as a function of the speed n for such a pump.

Many modifications of the examples shown are possible. Thus, for example, the openings 30, 31 and the passage may be formed by a single serpentine-like groove which extends (clockwise) in FIG. 3 from the right end of the opening 30 to the left end thereof, then horizontally to the left into the passage 33 and follows the latter until it extends substantially perpendicularly upwardly to the lower end of the opening 31, follows the latter up to the upper end and from the latter end finally again leads to the left into the passage 33 which it follows up to the opening 20. Also, for example, the openings 30, 31 may be made to extend spirally or circularly.

Figure 4:
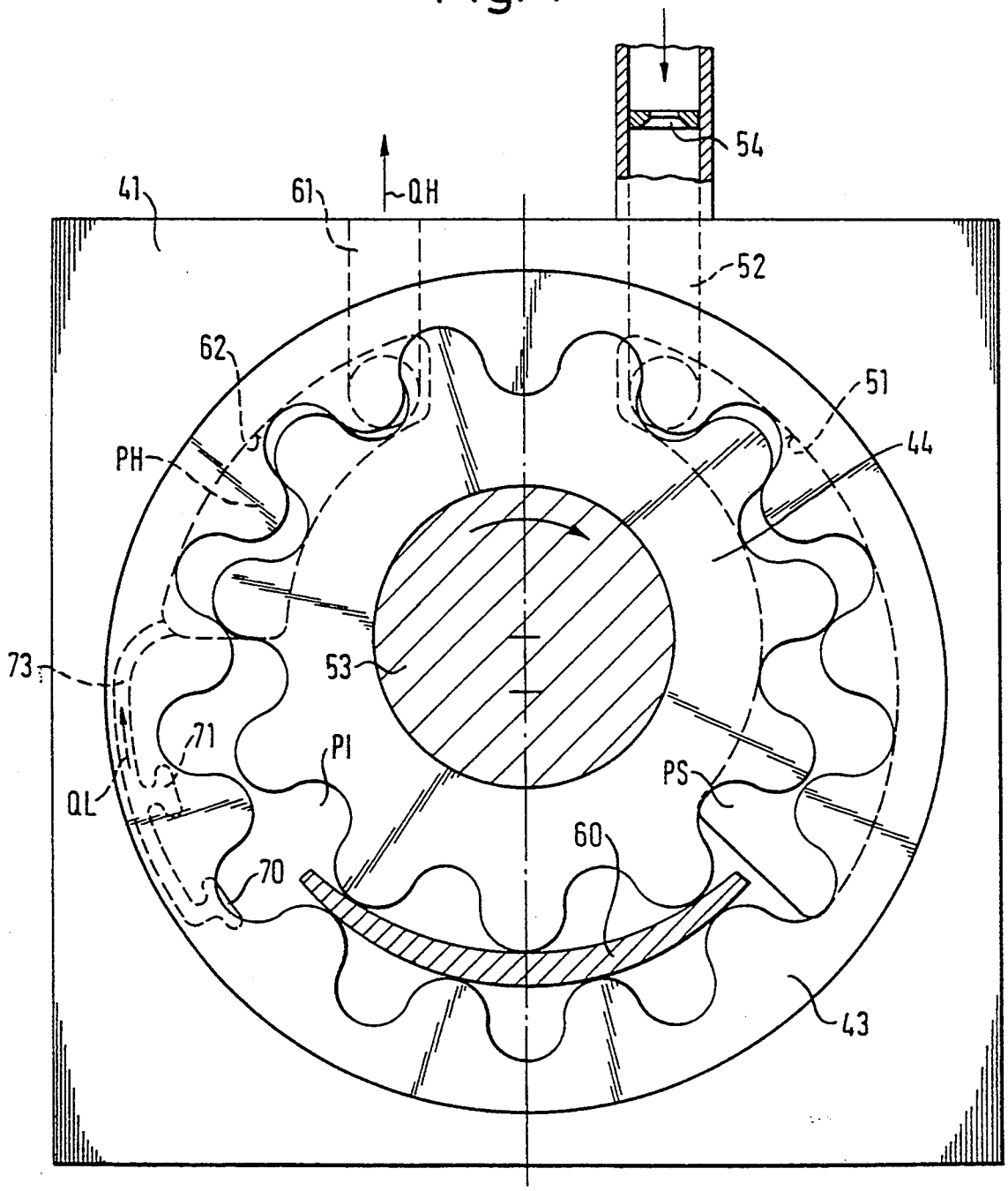
FIG. 4 is a diagram similar to FIG. 3 showing a further embodiment of a pump according to the invention in which the pinion has two teeth less than the ring gear and is therefore provided with a filling piece.

Like the pump according to FIG. 3, the pump shown in FIG. 4 has a housing 41 in which a ring gear 43 is mounted which meshes with a pinion 44. An intake 52 in which an orifice 54 is provided for suction control feeds an intake mouth 51 whilst an outlet mouth 60 is connected to an outlet passage 61. However, in contrast to the pump according to FIG. 3 the pinion 44 here has two teeth less than the ring gear 43 so that opposite the point of deepest tooth engagement, i.e. at the bottom in FIG. 4, a filling piece must be arranged in order to provide the necessary sealing there. As apparent from the foregoing, in this case as well the direction of rotation of the pump is clockwise.

As apparent from the drawings, the filling piece 60 is shortened at both ends because an excessively thin tapering of the already narrow filling piece would lead to undesirable fluttering. The ends of the filling piece are cut off so that in each case one tooth of the pinion and one tooth of the ring gear come simultaneously into and out of engagement with the filling piece.

The toothing is so constructed that the teeth come out of engagement and into engagement with each other just before the start of the filling piece and just after the end of the filling piece respectively. This means that the points of disengagement and engagement of the toothing lie close to the intersection points of the head circles of the two gears. Before and after these intersection points, i.e. in FIG. 4 roughly stated within the two upper thirds of the orbital path of the gears, each tooth of the pinion is permanently in engagement with the toothing of the ring gear. Now, according to the invention here as well two openings 70 and 71 are provided in the region between the end of the filling piece 60 lying in the delivery direction and the end of the outlet mouth 60 lying opposite the delivery direction. The two openings 70 and 71 are connected via the connecting passage 73 to the mouth 60 of the outlet passage 61. As regards the function and mode of operation of this construction, essentially the same applies as to the pump according to FIG. 3. The only difference is that here the region of the diminishing displacement cells to be relieved through the openings 70 and 71 at low speed of the pump extends only between the left end of the filling piece 60 in FIG. 4 and the lower end of the outlet mouth 62.

Otherwise, the application of the principle of the invention is the same as with the pump according to FIG. 3.

I claim:

1. Internal ring gear pump for a wide speed range comprising a housing containing a gear chamber, a ring gear in the housing, a pinion which has one tooth less or only a few teeth less than the ring gear, meshes with the ring gear and is arranged in the ring gear, the teeth of the pinion forming together with the teeth of the ring gear increasing and again diminishing consecutive displacement cells for the working liquid and sealing said cells with respect to each other, inlet and outlet passages passing through the housing for the supply and discharge of the operating liquid, the inlet and outlet passages opening into the gear chamber at respective inlet and outlet mouths on both sides of a point of deepest tooth engagement, the inlet and outlet mouths being located such that they are passed over by the displacement cells, and the end of the outlet mouth furthest from the point of deepest tooth engagement being located such that between it and a point at which the displacement cells start to diminish there is always more than one displacement cell, and a plurality of openings in a wall of the gear chamber in a region of diminishing displacement cells, the openings being peripherally spaced from the mouth of the outlet passage and located such that the displacement cells and teeth defining said cells alternately pass thereover, the openings being connected via a common connecting passage to the outlet passage, and each opening being located such that on each passage of a tooth thereover it is covered by said tooth completely or at least to a major degree.

2. Internal gear pump according to claim 1, wherein each one of the openings is small compared with the mouth of the outlet passage and the cross-section of the connecting passage is small compared with that of the outlet passage.

3. Internal gear pump according to claim 1, wherein each one of the openings is formed as a groove in an end wall of the gear chamber extending in the peripheral direction near a foot circle of one of the toothing of the pinion of the ring gear.

4. Internal gear pump according to claim 1, wherein the connecting passage is formed as a groove in the wall of the gear chamber covered by a body of the gear carrying the teeth passing thereover.

5. Internal gear pump according to claim 4, wherein the connecting passage branches off radially from the openings.

6. Internal gear pump according to claim 1, having a tooth number difference of one, and wherein the spacing of the opening from the mouth of the outlet passage in the peripheral direction is equal to about half the distance between the end of the mouth of the inlet channel and the end of the mouth of the outlet channel.

7. Internal gear pump according to claim 1, having a tooth number difference of more than one and comprising a filling piece in a space between a head circle of the ring gear and a head circle of the pinion opposite the point of deepest tooth engagement, and wherein the spacing, measured in a delivery direction, of the opening from a pressure-side end of the filling piece is substantially equal to zero.

8. Internal gear pump according to claim 1, including a suction control having one of a fixed or variable throttle arranged in the inlet passage.

9. Internal ring gear pump for a wide speed range comprising a housing containing a gear chamber, a ring gear in the housing, a pinion which has one tooth less or only a few teeth less than the ring gear, meshes with the ring gear and is arranged in the ring gear, the teeth of the pinion forming together with the teeth of the ring gear increasing and again diminishing consecutive displacement cells for the working liquid and sealing said cells with respect to each other, inlet and outlet passages passing through the housing for the supply and discharge of the operating liquid, the inlet and outlet passages opening into the gear chamber at respective inlet and outlet mouths on both sides of a point of deepest tooth engagement, the inlet and outlet mouths being located such that they are passed over by the displacement cells, and the end of the outlet mouth furthest from the point of deepest tooth engagement being located such that between it and a point at which the displacement cells start to diminish there is always more than one displacement cell, and at least one opening in a wall of the gear chamber in a region of diminishing displacement cells, the opening being peripherally spaced from the mouth of the outlet passage and located such that the displacement cells and teeth defining said cells alternately pass thereover, the opening being connected via a connecting passage to the outlet passage, and the opening being located such that on each passage of a tooth thereover it is covered by said tooth completely or at least to a major degree, and wherein the teeth have a height and the opening extends radially a distance that is one fifth to one third of the height of the teeth passing thereover.

10. Internal ring gear pump for a wide speed range comprising a housing containing a gear chamber, a ring gear in the housing, a pinion which has one tooth less or only a few teeth less than the ring gear, meshes with the ring gear and is arranged in the ring gear, the teeth of the pinion forming together with the teeth of the ring gear increasing and again diminishing consecutive displacement cells for the working liquid and sealing said cells with respect to each other, inlet and outlet passages passing through the housing for the supply and discharge of the operating liquid, the inlet and outlet passage opening into the gear chamber at respective inlet and outlet mouths on both sides of a point of deepest tooth engagement, the inlet and outlet mouths being located such that they are passed over by the displacement cells, and the end of the outlet mouth furthest from the point of deepest tooth engagement being located such that between it and a point at which the displacement cells start to diminish there is always more than one displacement cell, and a plurality of openings in a wall of the gear chamber in a region of diminishing displacement cells, the openings being peripherally spaced from the mouth of the outlet passage and located such that the displacement cells and teeth defining said cells alternately pass thereover, each opening being connected via a connecting passage to the outlet passage, and each opening being located such that on each passage of a tooth thereover it is covered by said tooth completely or at least to a major degree, and wherein the plurality of openings are arranged consecutively in the peripheral direction and said openings are spaced apart a distance of about half a tooth pitch.

11. Internal gear pump according to claim 10, wherein the openings are connected via a common connecting passage to the outlet mouth.

12. Internal ring gear pump for a wide speed range comprising a housing containing a gear chamber, a ring gear in the housing, a pinion which has one tooth less or only a few teeth less than the ring gear, meshes with the ring gear and is arranged in the ring gear, the teeth of the pinion forming together with the teeth of the ring gear increasing and again diminishing consecutive displacement cells for the working liquid and sealing said cells with respect to each other, inlet and outlet passages passing through the housing for the supply and discharge of the operating liquid, the inlet and outlet passages opening into the gear chamber at respective inlet and outlet mouths on both sides of a point of deepest tooth engagement, the inlet and outlet mouths being located such that they are passed over by the displacement cells, and the end of the outlet mouth furthest from the point of deepest tooth engagement being located such that between it and a point at which the displacement cells start to diminish there is always more than one displacement cell, and at least one opening in a wall of the gear chamber in a region of diminishing displacement cells, the opening being peripherally spaced from the mouth of the outlet passage and located such that the displacement cells and teeth defining said cells alternately pass thereover, the opening being connected via a connecting passage to the outlet passage, and the opening being located such that on each passage of a tooth thereover it is covered by said tooth completely or at least to a major degree, and wherein the extent of the opening in the peripheral direction is substantially equal to the thickness of the teeth at the region thereof that passes over the opening.

13. Internal ring gear pump for a wide speed range comprising a housing containing a gear chamber, a ring gear in the housing, a pinion which has one tooth less or only a few teeth less than the ring gear, meshes with the ring gear and is arranged in the ring gear, the teeth of the pinion forming together with the teeth of the ring gear increasing and again diminishing consecutive displacement cells for the working liquid and sealing said cells with respect to each other, inlet and outlet passages passing through the housing for the supply and discharge of the operating liquid, the inlet and outlet passages opening into the gear chamber at respective inlet and outlet mouths on both sides of a point of deepest tooth engagement, the inlet and outlet mouths being located such that they are passed over by the displacement cells, and the end of the outlet mouth furthest from the point of deepest tooth engagement being located such that between it and a point at which the displacement cells start to diminish there is always more than one displacement cell, and at least one opening in a wall of the gear chamber in a region of diminishing displacement cells, the opening being peripherally spaced from the mouth of the outlet passage and located such that the displacement cells and teeth defining said cells alternately pass thereover, the opening being connected via a connecting passage to the outlet passage, and the opening being located such that on each passage of a tooth thereover it is covered by said tooth completely or at least to a major degree, and wherein the distance of the opening from the mouth of the outlet passage in the peripheral direction is substantially equal to the pitch of the teeth.

* * * * *